US006864591B2

(12) United States Patent
DeFrank

(10) Patent No.: US 6,864,591 B2
(45) Date of Patent: Mar. 8, 2005

(54) SPRINKLER ACTIVATED GENERATOR

(76) Inventor: Michael DeFrank, 19472 Farallon Rd., Madera, CA (US) 93638

( * ) Notice: Subject to any disclaimer, the term of this patent is extended or adjusted under 35 U.S.C. 154(b) by 133 days.

(21) Appl. No.: 10/441,374

(22) Filed: May 20, 2003

(65) Prior Publication Data

US 2004/0232701 A1 Nov. 25, 2004

(51) Int. Cl.[7] ..... F03B 13/00
(52) U.S. Cl. ..... 290/1 R; 290/54
(58) Field of Search ..... 290/1 R, 54, 43

(56) References Cited

U.S. PATENT DOCUMENTS

| | | | | |
|---|---|---|---|---|
| 3,642,204 A | * | 2/1972 | McCloskey | 239/63 |
| 3,845,291 A | * | 10/1974 | Portyrata | 362/192 |
| RE31,023 E | | 9/1982 | Hall, III | |
| 4,352,025 A | * | 9/1982 | Troyen | 290/54 |
| 4,488,055 A | * | 12/1984 | Toyama | 290/53 |
| 4,522,338 A | | 6/1985 | Williams | |
| 4,564,889 A | | 1/1986 | Bolson | |
| 4,616,298 A | | 10/1986 | Bolson | |
| 4,660,766 A | | 4/1987 | Nelson et al. | |
| 4,731,545 A | | 3/1988 | Lerner et al. | |
| 4,838,310 A | | 6/1989 | Scott et al. | |
| 4,877,189 A | | 10/1989 | Williams | |
| 4,920,465 A | | 4/1990 | Sargent | |
| 5,140,254 A | * | 8/1992 | Katzman | 322/35 |
| 6,336,596 B1 | * | 1/2002 | Katzman et al. | 239/204 |
| 6,798,080 B1 | * | 9/2004 | Baarman et al. | 290/43 |

FOREIGN PATENT DOCUMENTS

FR 2725502 A1 * 4/1996 ..... F25C/3/04

* cited by examiner

*Primary Examiner*—Joseph Waks
(74) *Attorney, Agent, or Firm*—Fulwider, Patton, Lee & Utecht, LLP

(57) ABSTRACT

An irrigation device, such as a sprinkler, includes an electric generator for generating electricity. The sprinkler includes a nozzle which couples to a fluid conduit, a rotary deflector positioned downstream from the nozzle and within the atmosphere, an electric generator coupled to the rotary deflector, and a frame coupling the nozzle to the electric generator. The rotary deflector rotates about an axis as a fluid stream exiting the nozzle contacts and sprays from the rotary deflector. The rotary deflector and the rotor of the electric generator are coupled to a common axial shaft such that rotations of the rotary deflector translate to rotations of the rotor.

20 Claims, 1 Drawing Sheet

FIG. 1
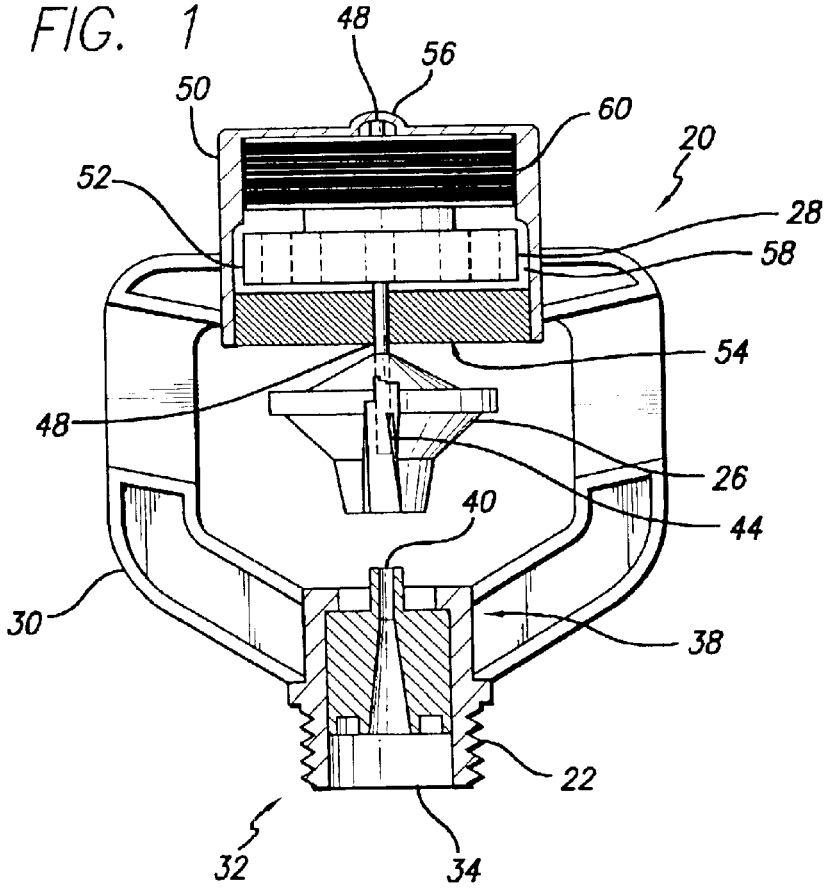
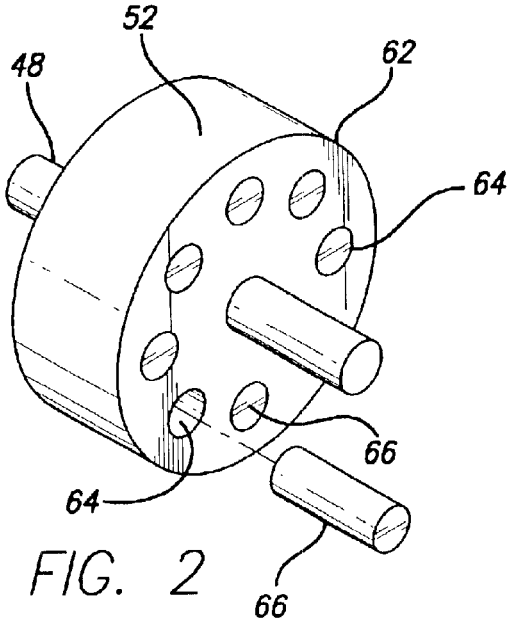
FIG. 2
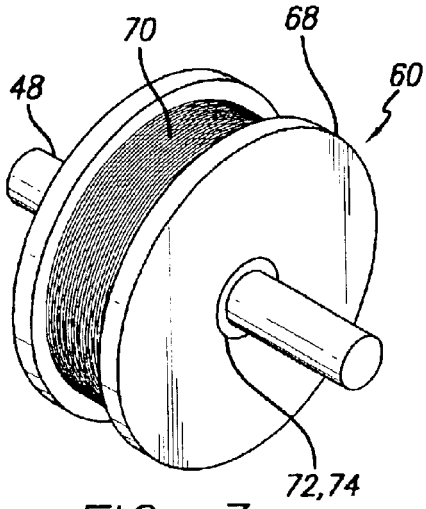
FIG. 3

SPRINKLER ACTIVATED GENERATOR

BACKGROUND OF THE INVENTION

This invention relates to irrigation devices and in particular to irrigation devices including generators utilizing the fluid flowing through the irrigation device to generate electricity.

The use of irrigation devices, or other fluid devices or appliances, to generate electricity is well known. Such devices often include an impeller positioned within the device, such as within a hose, pipe or other housing, which is rotated as the fluid, such as water, flows past the impeller. As such, the fluid turns the impeller before the fluid enters the atmosphere. The impeller is often coupled to the rotor portion of a generator such that the rotor of the generator turns as the fluid flows past and turns the impeller. With the impeller positioned within the device, the impeller expends some of the force of the liquid, thereby reducing the fluid pressure downstream from the impeller. In the case of an irrigation sprinkler, such reduction in fluid pressure may reduce the fluid distribution area of the sprinkler.

What has been needed is an irrigation device, such as a sprinkler, including an electric generator, wherein the mechanism which drives the rotor of the generator is positioned within the atmosphere and thereby maintains or improves the distribution area of the sprinkler as compared to similar irrigation devices which do not include the generator. The present invention satisfies these needs.

SUMMARY OF THE INVENTION

The present invention is directed to an irrigation device, such as a sprinkler, including an electric generator. A mechanism which drives the rotor of the generator is positioned within the atmosphere, and not in a fluid conduit, thereby maintaining or improving the distribution area of the sprinkler.

In one embodiment of the invention, the irrigation device includes a nozzle, an electric generator positioned downstream from the nozzle, a frame coupling the electric generator to the nozzle, and a rotary deflector coupled to the electric generator. The rotary deflector is positioned within the atmosphere, downstream from the nozzle, and between the nozzle and the electric generator.

In one aspect of the invention, the nozzle includes a fluid inlet portion which is configured to be coupled to a fluid conduit. The nozzle includes an inlet orifice and an outlet orifice which is smaller than the inlet orifice. The outlet orifice may be positioned proximate the rotary deflector while the inlet orifice is positioned further from the rotary deflector than the outlet orifice.

In one embodiment of the invention, the rotary deflector is mounted for rotational movement about a rotational axis. The rotary deflector includes fluid stream engagement means which is configured so that upon contact with a fluid stream which exits from the outlet orifice of the nozzle, a reactionary force component is established which acts on the rotary deflector in a direction tangential to the rotational axis of the rotary deflector to effect rotational movement of the rotary deflector about the rotational axis. In one embodiment of the invention, the rotational axis of the rotary deflector is substantially coaxially aligned with the axis of the fluid stream. However, in other embodiments of the invention, the rotational axis of the rotary deflector is positioned offset from the axis of the fluid stream or at an angle to the axis of the fluid stream.

The irrigation device may include a generator housing which is coupled to the frame, with the electric generator being positioned within the generator housing. The electric generator may include a rotatable rotor assembly and a stationary stator assembly. The rotor assembly may include a permanent magnet member having a plurality of circumferentially spaced openings proximate a periphery of the permanent magnet member. A magnet may be positioned in each of the circumferentially spaced openings. The stator assembly may include a bobbin and a coil wound upon the bobbin. The coil may include a metallic wire.

The irrigation device may also include a shaft. The shaft may couple the rotary deflector to the electric generator in such manner that rotations of the rotary deflector cause the shaft to rotate, which in turn causes the rotor to rotate about the axis of the shaft.

Other features and advantages of the present invention will become more apparent from the following detailed description of the invention, when taken in conjunction with the accompanying exemplary drawings.

BRIEF DESCRIPTION OF THE DRAWINGS

FIG. 1 is an elevational view, partially in section, of an example of an irrigation device embodying features of the present invention.

FIG. 2 is a perspective view depicting an example of a rotor assembly of an electric generator incorporated in the irrigation device of FIG. 1.

FIG. 3 is a perspective view depicting an example of a stator assembly of an electric generator incorporated in the irrigation device of FIG. 1.

DETAILED DESCRIPTION OF THE PREFERRED EMBODIMENTS

The present invention electricity generating irrigation device improves upon existing electricity generating irrigation devices by positioning the mechanism which drives the rotor of the generator within the atmosphere. Positioning the rotor driving mechanism within the atmosphere causes little or no impairment to the distribution area of the sprinkler as compared to similar irrigation devices which do not include the generator. In one preferred embodiment of the invention, the rotor driving mechanism is a rotary deflector (FIG. 1). In another preferred embodiment of the invention, the rotor driving mechanism is a rotatable arm (not shown).

Turning to the drawings, FIG. 1 depicts a sprinkler 20 of the present invention. The sprinkler includes a nozzle 22 which couples to a fluid conduit, such as a pipe, tube or hose (not shown). The sprinkler also includes a rotary deflector 26 positioned downstream from the nozzle and an electric generator 28 coupled to the rotary deflector. A frame 30 supports the nozzle 22 and the electric generator 28 and couples the electric generator to the nozzle.

In one embodiment of the invention, the nozzle 22 includes a fluid inlet portion 32 including an inlet orifice 34. The fluid inlet portion 32 may also include coupling means for coupling the nozzle to the fluid conduit. A fluid outlet portion 38 of the nozzle 22 may include an outlet orifice 40 sized smaller than the inlet orifice such that the fluid velocity increases as the fluid flows through the nozzle. However, in another embodiment of the invention, the outlet orifice may be about the same size as the inlet orifice or larger than the outlet orifice. The outlet orifice directs the source of the fluid under pressure into an atmospheric condition in a stream. In one embodiment of the invention, the fluid stream includes a generally vertically extending axis, while in other embodiments of the invention the fluid stream may include an axis extending in other directions as the configuration dictates. In one embodiment of the invention, the outlet orifice of the nozzle is positioned proximate the rotary deflector 26 and the inlet orifice of the nozzle is positioned further from the rotary deflector than the outlet orifice.

The rotary deflector 26 is positioned within the atmosphere. The rotary deflector 26 is mounted for rotational movement about a rotational axis. In one embodiment of the invention, the rotational axis of the rotary deflector 26 is substantially coaxially aligned with the axis of the fluid stream which exits from the outlet orifice 40 of the nozzle 22. In other embodiments of the invention (not shown), the rotational axis of the rotary deflector 26 may be offset from the axis of the fluid stream and/or at an angle to the axis of the fluid stream. The rotary deflector 26 includes fluid stream engagement means configured to establish a reactionary force component acting on the rotary deflector in a direction tangential to the rotational axis of the rotary deflector 26. The reactionary force effects rotational movement of the rotary deflector about its rotational axis. In one embodiment of the invention, the rotary deflector includes a flow director channel 44, for engaging the fluid stream. The fluid stream engagement means, such as the flow director channel 44, of the rotary deflector 26 may convert the fluid stream into a spray moving radially away from the rotary deflector. In one embodiment of the invention, the rotary deflector 26 is mounted to a shaft 48. The shaft may extend axially from the rotary deflector body and away from the nozzle. The shaft is coupled to the rotary deflector through methods which are well known in the art.

The shaft 48 functions as an axle for rotating a rotor assembly portion 52 of the electric generator 28 about the axis of the shaft. In one embodiment of the invention, as depicted in FIG. 1, the electric generator is positioned within an electric generator housing 50. The electric generator housing 50 may include a substantially open end 54 and a substantially closed end 56. In one embodiment of the invention, the open end 54 of the generator housing 50 opens to an aperture 58 which houses the rotor assembly 52 and a stator assembly portion 60 of the electric generator. The aperture may include a longitudinal axis which is substantially coaxially aligned with the axis of the shaft.

The electric generator 28 may be of any suitable configuration which is well known in the art. For example, as depicted in FIGS. 1 and 2, one embodiment of the invention includes an electric generator with the rotor assembly having a permanent magnet member 62 secured axially to the shaft 48. The permanent magnet member may include a plurality of circumferentially-spaced openings 64 formed therein, proximate the periphery of the permanent magnet member, with a magnet 66 positioned in each of the openings. In one embodiment of the invention, the openings 64 in the permanent magnet member 62 and the magnets 66 each include a cylindrical shape.

Referring to FIGS. 1 and 3, in one embodiment of the invention, the stator assembly 60 may be fixedly positioned within the aperture of the generator housing 50. The stator assembly 60 may include a bobbin 68 having a coil 70 of a conductive metallic wire, such as a copper wire, wound upon the bobbin. The center of the bobbin may include an open hub 72 through which the shaft 48 extends. A bushing or bearing 74 may be mounted inside the hub 72 to facilitate alignment of the shaft and to reduce friction between the shaft and the bobbin 68. The stator assembly 60 may be secured to the aperture 58 of the generator housing 50 through means well known in the art.

In use, the electricity generating irrigation device 10, is coupled to a fluid conduit (not shown), such as a pipe. A fluid, such as water, enters the fluid inlet portion 32 of the nozzle 22, exits the outlet orifice 40 of the nozzle, and enters the atmosphere. The fluid then contacts the rotary deflector 26 in such manner to establish the reactionary force component to effect rotational movement of the rotary deflector about its rotational axis. In one embodiment of the invention, the fluid exiting through the outlet orifice 40 of the nozzle 22 enters the deflector channel 44 of the rotary deflector 26 and issues out and away from the rotary deflector in a spray pattern. Because of the configuration of the flow director channel 44, with an exit portion thereof pointing in a direction tangential to the rotational axis of the rotary deflector 26, a reactionary force is created as the fluid flows through the flow director channel which causes the rotary deflector to rotate about its rotational axis.

The nozzle 22, frame 30 and generator housing 50 may be formed from a plastic material, such as nylon, and molded together into a single unit. Alternatively, the nozzle, frame and generator housing may be formed separately and coupled together. Further, the nozzle, frame and generator housing may be made by other methods well known in the art or from other materials well known in the art. The shaft 48 may be made from a metallic material, such as stainless steel, or other suitable materials well known in the art.

In one embodiment of the invention, rotation of the rotary deflector 26 causes the shaft 48 to rotate, which in turn causes the rotor assembly 52 to rotate. As the rotor assembly 52 is rotated, an electrical current is generated in the coil 70 in the stator assembly 60. The generated electricity may by conducted out of the irrigation device 10 via wires (not shown) coupled to the coil 70 and delivered by the wires to electrical components (not shown) for storage or use.

With the rotary deflector 26 and generator 28 positioned downstream from the point at which the fluid enters the atmosphere, the fluid distribution pattern, such as a spray pattern, created by the irrigation device 10 of the present invention experiences little or no impairment, as compared to devices which include an impeller positioned within the fluid conduit to turn the rotor of the generator. In fact, as the electric generator 28 tends to decrease the rotation speed of the rotary deflector 26, the throw distance of the distribution pattern may be increased by reducing the rooster tail effect of the distribution pattern caused by a quicker rotation of the rotary deflector.

Although the above description of the present invention describes particular configuration, the invention is not limited to such configuration. Other modifications and improvements may be made without departing from the scope of the invention.

What is claimed is:

1. An irrigation device, comprising:

a nozzle;

an electric generator positioned downstream from the nozzle;

a frame coupling the electric generator to the nozzle; and a rotor drive mechanism coupled to the electric generator, the rotor drive mechanism positioned within the atmosphere, downstream from the nozzle, and between the nozzle and the electric generator.

2. The irrigation device of claim 1, wherein the nozzle includes a fluid inlet portion which is configured to be coupled to a fluid conduit.

3. The irrigation device of claim 1, wherein the nozzle includes an inlet orifice and an outlet orifice, the outlet orifice being smaller than the inlet orifice.

4. The irrigation device of claim 3, wherein the outlet orifice is positioned proximate the rotor drive mechanism and the inlet orifice is positioned further from the rotor drive mechanism than the outlet orifice.

5. The irrigation device of claim 1, wherein the rotor drive mechanism is a rotary deflector.

6. The irrigation device of claim 5, wherein:

the rotary deflector is mounted for rotational movement about a rotational axis; and the rotary deflector includes fluid stream engagement means, the fluid stream engagement means being configured so that upon contact with a fluid stream which exits from an outlet orifice of the nozzle, a reactionary force component is established which acts on the rotary deflector in a direction tangential to the rotational axis of the rotary deflector to effect rotational movement of the rotary deflector about the rotational axis.

7. The irrigation device of claim 6, wherein the rotational axis of the rotary deflector is positioned substantially coaxially aligned with the axis of the fluid stream.

8. The irrigation device of claim 6, wherein the rotational axis of the rotary deflector is positioned offset from the axis of the fluid stream.

9. The irrigation device of claim 6, wherein the rotational axis of the rotary deflector is positioned at an angle to the axis of the fluid stream.

10. The irrigation device of claim 1, further comprising a generator housing coupled to the frame, the electric generator being positioned within the generator housing.

11. The irrigation device of claim 1, wherein the electric generator includes a rotatable rotor assembly and a stationary stator assembly.

12. The irrigation device of claim 11, wherein the rotor assembly includes a permanent magnet member having a plurality of circumferentially spaced openings proximate a periphery of the permanent magnet member, and a magnet positioned in each of the openings.

13. The irrigation device of claim 11, wherein the stator assembly includes a bobbin and a coil wound upon the bobbin.

14. The irrigation device of claim 13, wherein the coil includes a metallic wire.

15. The irrigation device of claim 11, further comprising a shaft coupling the rotor drive mechanism to the electric generator such that rotations of the rotor drive mechanism rotate the shaft and the rotor assembly of the electric generator.

16. An irrigation device, comprising:

a nozzle having an inlet portion configured to be coupled to a fluid conduit, an inlet orifice positioned within the inlet portion, and an outlet orifice which is smaller than the inlet orifice;

a generator housing positioned down stream from the nozzle;

a frame coupling the generator housing to the nozzle;

an electric generator positioned within the generator housing, the electric generator including a rotatable rotor assembly and a stationary stator assembly;

a rotary deflector coupled to the electric generator, the rotary deflector being mounted for rotational movement about a rotational axis, the rotary deflector being positioned within the atmosphere, downstream from the nozzle, and between the nozzle and the electric generator, the rotary deflector including fluid stream engagement means, the fluid stream engagement means being configured so that upon contact by the fluid stream, a reactionary force component is established which acts on the rotary deflector in a direction tangential to the rotational axis of the rotary deflector to effect rotational movement of the rotary deflector about its rotational axis; and a shaft coupling the rotary deflector to the electric generator such that rotations of the rotary deflector rotate the shaft and the rotor assembly of the electric generator.

17. The irrigation device of claim 16, wherein the outlet orifice of the nozzle is positioned proximate the rotary deflector and the inlet orifice of the nozzle is positioned further from the rotary deflector than the outlet orifice.

18. The irrigation device of claim 16, wherein the rotor assembly of the electric generator includes a permanent magnet member having a plurality of circumferentially spaced openings proximate a periphery of the permanent magnet member, and a magnet positioned in each of the openings.

19. The irrigation device of claim 16, wherein the stator assembly includes a bobbin and a coil wound upon the bobbin.

20. The irrigation device of claim 19, wherein the coil includes a metallic wire.

* * * * *